US010870803B2

(12) United States Patent
Karimzadeh

(10) Patent No.: US 10,870,803 B2
(45) Date of Patent: Dec. 22, 2020

(54) METHOD FOR UPGRADING A HYDROCARBON FEED

(71) Applicant: Ramin Karimzadeh, Tehran (IR)

(72) Inventor: Ramin Karimzadeh, Tehran (IR)

( * ) Notice: Subject to any disclaimer, the term of this patent is extended or adjusted under 35 U.S.C. 154(b) by 251 days.

(21) Appl. No.: 15/592,170

(22) Filed: May 10, 2017

(65) Prior Publication Data

US 2017/0240822 A1 Aug. 24, 2017

Related U.S. Application Data

(60) Provisional application No. 62/363,213, filed on Jul. 16, 2016.

(51) Int. Cl.
*C10G 51/02* (2006.01)

(52) U.S. Cl.
CPC ... *C10G 51/023* (2013.01); *C10G 2300/4075* (2013.01)

(58) Field of Classification Search
CPC ..... C10G 51/023; C10G 9/36; C10G 9/16; C10G 9/18
See application file for complete search history.

(56) References Cited

U.S. PATENT DOCUMENTS 4,213,846 A 7/1980 Sooter et al.
5,976,352 A * 11/1999 Busson ..... C10G 9/16 208/75
6,027,635 A 2/2000 Busson et al.
7,597,797 B2 10/2009 Gregory
7,718,052 B2 5/2010 Brewer et al.
8,815,080 B2 8/2014 Sundaram
8,864,977 B2 10/2014 Spicer
9,359,555 B2 6/2016 Bhirud
2007/0232845 A1* 10/2007 Baumgartner ..... C10G 9/14 585/648
2010/0191031 A1* 7/2010 Sundaram ..... C07C 2/78 585/656
2014/0024873 A1* 1/2014 De Haan ..... C10G 75/00 585/648

OTHER PUBLICATIONS

Q. L. Chen, Energy-use analysis and improvement for delayed coking units, Energy, 2004, vol. 29, pp. 2225-2237.
Valentin Plesu, Thermal coupling between crude distillation and delayed coking units, Applied Thermal Engineering, 2003, vol. 23, pp. 1857-1869.
F. Rodriguez-Reinoso, Delayed coking: industrial and laboratory aspects, Carbon, 1997, vol. 36, pp. 105-116.

* cited by examiner

*Primary Examiner* — Michelle Stein
(74) *Attorney, Agent, or Firm* — Bajwa IP Law Firm; Haris Zaheer Bajwa

(57) ABSTRACT

A method for upgrading a hydrocarbon feed is disclosed. The method may be carried out in a pyrolysis furnace that may have at least two coils and at least two thermal zones. The method may include two operating or run modes that may be repeated in a cycle. In one run, upgrading may be carried out in one coil while decoking may be carried out in the other coil. After a predetermined amount of time, the streams of the two coils may be switched for a second run, such that decoking may be carried out in the coil in which upgrading was done in the first run and upgrading may be carried out in the coil in which decoking was done in the first run. The first and the second run are cyclically repeated one after the other.

11 Claims, 5 Drawing Sheets

METHOD FOR UPGRADING A HYDROCARBON FEED

CROSS-REFERENCE TO RELATED APPLICATION

This application claims the benefit of priority from U.S. Provisional Patent Application Ser. No. 62/363,213, filed on Jul. 16, 2016, and entitled "A CYCLICAL FURNACE FOR CATALYTIC OR THERMAL UPGRADING OF LIGHT, HEAVY AND WASTE HYDROCARBONS," which is incorporated herein by reference in its entirety.

TECHNICAL FIELD

The present disclosure generally relates to the upgrading of hydrocarbon feeds, and particularly to a method and a pyrolysis furnace for upgrading hydrocarbon feeds, such as light, heavy, and waste hydrocarbons.

BACKGROUND

In order to upgrade and improve heavy oil compounds, a heating or catalytic, method may be used. In thermal processing, or delayed coking, hydrocarbon feedstock along with steam may enter a reactor tube placed in the radiant zone of a furnace. The feedstock may be heated by the burners of the furnace and they may be converted into lighter products. Along with the liquid and gas products, unwanted solid products (coke) may form inside the reactor tube or coil. A part of the formed coke may be routed out of the reactor, while some parts may remain on the walls of reactor tubes or coils.

Coke accumulation on the walls of the reactor increases the pressure and temperature of the process over time. Therefore, in predetermined intervals, the working furnace may be taken out of service for decoking the coils, and a replacement furnace may be used. The decoking process may be carried out at high-temperatures by steam and oxygen.

Upgrading processes of hydrocarbon feeds may require an additional furnace or a replacement furnace to allow for off-line decoking of the working furnace. This may have disadvantages that may include but are not limited to higher costs for building the additional furnace. Therefore, there is a need in the art for a method of upgrading that does not require an additional furnace. Moreover, in upgrading processes for hydrocarbon feeds, a better control over the temperature distribution in the thermal zones is needed.

SUMMARY

This summary is intended to provide an overview of the subject matter of this patent, and is not intended to identify essential elements or key elements of the subject matter, nor is it intended to be used to determine the scope of the claimed implementations. The proper scope of this patent may be ascertained from the claims set forth below in view of the detailed description below and the drawings.

In one general aspect, the present disclosure is directed to a method for upgrading a hydrocarbon feed in a pyrolysis furnace. The method includes associating at least a first coil with a first thermal zone of the pyrolysis furnace, associating at least a second coil with a second thermal zone of the pyrolysis furnace, the second thermal zone being spaced apart from the first thermal zone, and operating the pyrolysis furnace in a first mode. The first mode can involve upgrading a first hydrocarbon feed in the second coil, feeding a first steam stream to the first coil, thereby heating the first steam stream, and decoking the first coil.

The above general aspect may include one or more of the following features. For example, operating the pyrolysis furnace in the first mode may further include mixing the first steam stream from the first coil with the first hydrocarbon feed in the first thermal zone, thereby producing a combined first hydrocarbon/steam stream; and feeding the first hydrocarbon/steam stream to the second coil in the second thermal zone. In addition, the method can comprise operating the pyrolysis furnace in a second mode, the second mode including upgrading a second hydrocarbon feed in the first coil; feeding a second steam stream to the second coil, thereby heating the second steam stream; and decoking the second coil. As another example, operating the pyrolysis furnace in the second mode may further include mixing the second steam stream from the second coil with the second hydrocarbon feed in the second thermal zone, thereby producing a combined second hydrocarbon/steam stream; and feeding the second, hydrocarbon/steam, stream to the first coil, in the first thermal zone. In some cases, the first thermal zone may operate as a radiant zone in the first mode and as a convection zone in the second mode. In other cases, the second thermal zone may operate as a convection zone in the first mode and as a radiant zone in the second mode. The method can further include switching the first thermal zone from the first mode to the second mode by turning off or decreasing the output of a first burner in the first thermal zone and opening a first stack in the first thermal zone. In addition, the method may include switching the second thermal zone from the first mode to the second mode by turning on a second burner in the second thermal zone and closing a second stack in the second thermal zone. In some cases, the method may include operating the pyrolysis furnace in the first mode and then the second mode in a series of repeating cycles. The method may include mixing the first steam stream with an oxidizing agent, wherein the oxidizing agent is selected from the group consisting of oxygen, air, $H_2O_2$, an alcohol, and combinations thereof. In other cases, the method, may further include feeding the first steam stream to the first coil from a first line, and feeding the first hydrocarbon/steam stream to the second coil from a second line during the first mode. In addition, the method may include feeding the second, steam stream to the second coil from the second line, and feeding the second hydrocarbon/steam, stream to the first coil from the first line during the second mode.

In another general aspect, the present disclosure is directed to a pyrolysis furnace for upgrading a hydrocarbon feed. The pyrolysis furnace can include a plurality of thermal zones, including a first thermal zone and a second thermal zone, where the second thermal zone is spaced apart from the first thermal zone. In addition, the first thermal zone includes a first stack and a first burner, the second thermal zone includes a second stack and a second burner, and the first thermal zone is configured to provide convection in, a first mode and radiation in a second mode.

The above general aspect may include one or more of the following features. For example, the pyrolysis furnace may further include a plurality of intermediate thermal zones disposed between the first thermal zone and the second thermal zone. In some cases, the first thermal zone may operate in the first mode when the first burner is turned off or decreased and the first stack is opened, and the first thermal zone may operate in the second mode when the first burner is turned on and the first stack is closed. The second thermal zone may be configured to provide radiation in the first mode and convection in the second mode. In addition, the second thermal zone may operate in the first mode when the second burner is turned off or decreased and the second stack is opened, and the second thermal zone may operate in the second mode when the second burner is turned on and the second stack is closed. The pyrolysis furnace may also include at least a first coil and a second coil in the pyrolysis furnace, the first coil being associated with the first thermal zone and the second coil being associated with the second thermal zone. In some cases, the pyrolysis furnace may include a first valve, the first valve configured to open or close the first stack. The first thermal zone and the second thermal zone may be separated by at least one refractory wall Other systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the following claims

BRIEF DESCRIPTION OF THE DRAWINGS

The drawing figures depict one or more implementations, in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings Upgrading processes of hydrocarbon feeds may require an additional furnace or a replacement furnace to allow for off-line decoking of the working furnace. This may have disadvantages that may include but are not limited to higher costs for building the additional furnace. The present disclosure describes an apparatus and a method of upgrading that does not require an additional furnace. Moreover, some implementations of the apparatus and method disclosed herein can provide improved control over the temperature distribution in the thermal zones.

Disclosed herein is a pyrolysis furnace and a method for upgrading a hydrocarbon feed in a cyclic process in which upgrading and decoking may continuously and periodically be performed in a number of coils in the pyrolysis furnace. The pyrolysis furnace of the present disclosure may include a number of thermal zones, for example, a first thermal zone and a second thermal zone, as well as a number of thermal zones in between. The pyrolysis furnace can also be associated with a number of coils, such as a first coil and a second coil that may enter the pyrolysis furnace and pass through the thermal zones. The first coil and the second coil may provide reactors in which the upgrading process may be carried out. A hydrocarbon feed may be fed to the first coil and steam or water may be fed to the second coil. The hydrocarbon feed in the first coil may be upgraded while the water or steam fed to the second coil may decoke the second coil. The hydrocarbon feed in the first coil may first enter a convection zone to be preheated and then it may flow through other thermal zones that may function as radiant zones (i.e., radiation heat-energy) for the upgrading process to occur. In the pyrolysis furnace of the present disclosure, the first and the second thermal zones may be symmetrically arranged at either ends of the pyrolysis furnace and may be designed such that their functionality may be switched between a convection zone and a radiant zone. Benefits from these features may include, but are not limited to, allowing the upgrading process to be carried out in the first coil, while decoking can occur in the second coil. In addition, after a predetermined amount of time the hydrocarbon feed and the steam streams may be switched between the coils and the upgrading process may be carried out in the second coil and steam may be fed to the first coil for decoking the first coil.

Figure 1:
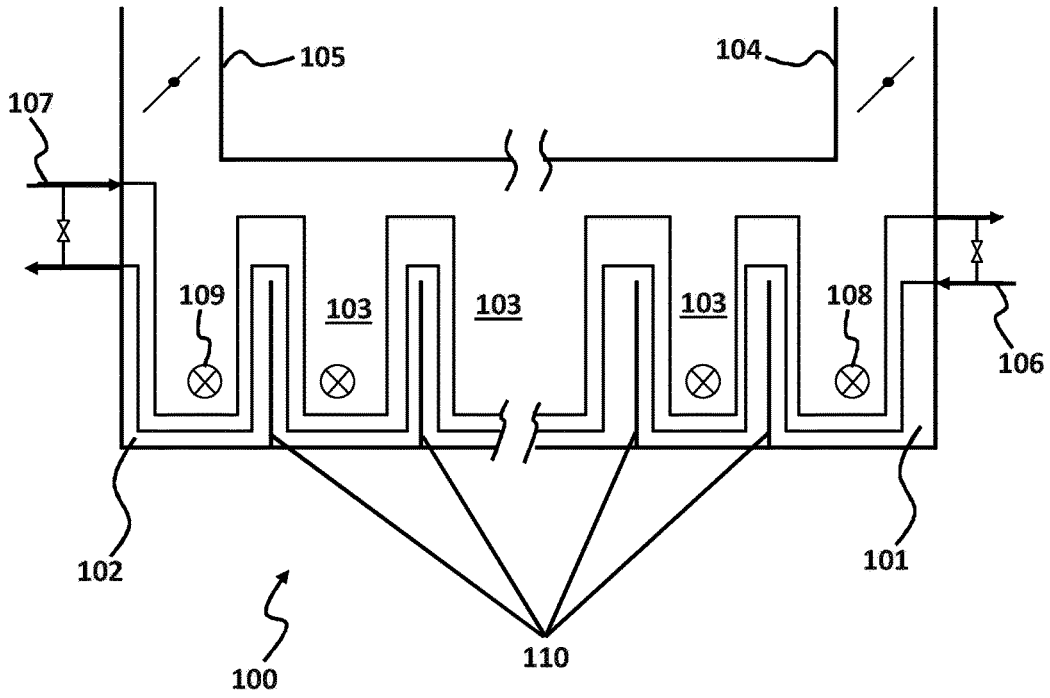
FIG. 1 illustrates an upgrading process carried out in a pyrolysis furnace, according to one or more implementations of the present disclosure.

FIG. 1 illustrates a schematic view of an upgrading process carried out in a pyrolysis furnace 100, according to one or more implementations of the present disclosure. As shown in the implementation presented in FIG. 1, the pyrolysis furnace 100 may include a plurality of thermal zones, including but not limited to a first thermal zone 101, a second thermal zone 102, and a number of thermal zones ("intermediate thermal zones") 103 in between. The first thermal zone 101 may include a first substantially symmetrical stack ("first stack") 104 and the second thermal zone 102 may include a second substantially symmetrical stack ("second stack") 105. The functionality of the first thermal zone 101 may be switched between a convection zone and a radiant zone by turning a first burner 108 on and off and opening and closing the first stack 104. Similarly, the functionality of the second thermal zone 102 may be switched between a convection zone and a radiant zone by turning a second burner 109 on and off and opening and closing the second stack 105. At least two coils (a first coil 106 and a second coil 107) may enter or be disposed in the pyrolysis furnace 100 and pass through one or more of the thermal zones (in FIG. 1, the first thermal zone 101, the second thermal zone 102, and the intermediate thermal zones 103).

In different implementations, the pyrolysis furnace 100 may operate in at least two modes, herein identified as a first mode of operation and a second mode of operation. During the first mode of operation, hydrocarbon feed may be fed to the first coil 106 and water or steam may be fed to the second coil 107. In some implementations, in this first mode, the first burner 108 of the first thermal zone 101 may be turned off or down or be otherwise decreased. In addition, the first stack 104 of the first thermal zone 101 may be opened in order for the first thermal zone 101 to function as a convection zone. The hydrocarbon feed in the first coil 106 then enters the convection zone to be preheated, and subsequently flows through the first coil 106 to other thermal zones (such as the second thermal zone 102 and the intermediate thermal zones 103) that function as radiant zones while the upgrading process occurs in the pyrolysis furnace for a predetermined amount of time, for example, at least 15 minutes. In one implementation, water or steam may flow through the second coil 107. In addition, during the first mode, the second thermal zone 102 may function as a radiant zone by turning on the second burner 109 of the second thermal zone 102 and closing the second stack 105 of the second thermal zone 102. Steam or water may be heated in the furnace in the second coil 107 and the flow of the steam in the second coil 107 may lead to a decoking of the second coil 107. In some implementations, the heated steam from the second coil 107 may be mixed with the hydrocarbon of the first coil 106 prior the upgrading process.

During the second mode of operation, the streams of hydrocarbon feed and water or steam, may be switched, between the first coil 106 and the second coil 107. The hydrocarbon feed may be fed to the second coil 107, while the steam or water may be diverted to the first coil 106. In some implementations, during the second mode, the second burner 109 of the second thermal zone 102 may be turned off or down or be otherwise decreased. In addition, the second stack 105 of the second thermal zone 102 may be opened in order for the second thermal zone 102 to function as a convection zone. The hydrocarbon feed in the second coil 107 may enter the convection, zone for preheating and may subsequently flow through the second coil 107 to other thermal zones (such as the first thermal zone 101 and the intermediate thermal zones 103) that function as radiant zones for the upgrading process to occur in the furnace. In one implementation, the water or steam may flow through the first coil 106. In addition, during the second mode, the first thermal zone 101 may function as a radiant zone by turning on the first burner 108 of the first thermal zone 101 and closing the first stack 104 of the first thermal zone 101. The steam or water may be heated in the furnace in the first coil 106 and the flow of the steam in the first coil 106 may lead to the decoking of the first coil 106. The heated steam from the first coil 106 may be mixed with the hydrocarbon of the second coil 107 prior the upgrading process in one implementation. In some implementations, two or more thermal zones may optionally be spaced apart or separated by one or more refractory walls 110. Benefits of separating the thermal zones in the furnace may include but are not limited to: improved temperature distribution inside the furnace, increased efficiency of the radiant section of the furnace, and improved control over the temperature profile along the furnace.

In different implementations, it should be understood that the first mode and second mode may be repeated. In some implementations, the first mode and second mode can be run in a cycle, providing a cyclic process in which upgrading the hydrocarbon occurs in one coil while the other coil is being decoked by a stream of steam. During this cycle the streams of the two coils may be switched and the coil in which the upgrading process occurred can undergo the decoking process while the upgrading process occurs in the other coil.

In some implementations, the steam may be mixed with an oxidizing agent, such as oxygen, air, $H_2O_2$, and/or an alcohol such as methanol, or combinations thereof. In some implementations, the oxidizing agent has a concentration of 0 to 100 weight percent of the mixture. In other implementations, the steam may be mixed with hydrogen. In one implementation, the concentration of hydrogen is between 0 to 100 weight percent of the mixture. The upgrading process may include but is not limited to thermal cracking, steam cracking, pyrolysis, or catalytic versions of the aforementioned processes. Furthermore, in some implementations, the first and the second coils include a catalyst for catalytic upgrading of the hydrocarbon feed.

Figure 2:
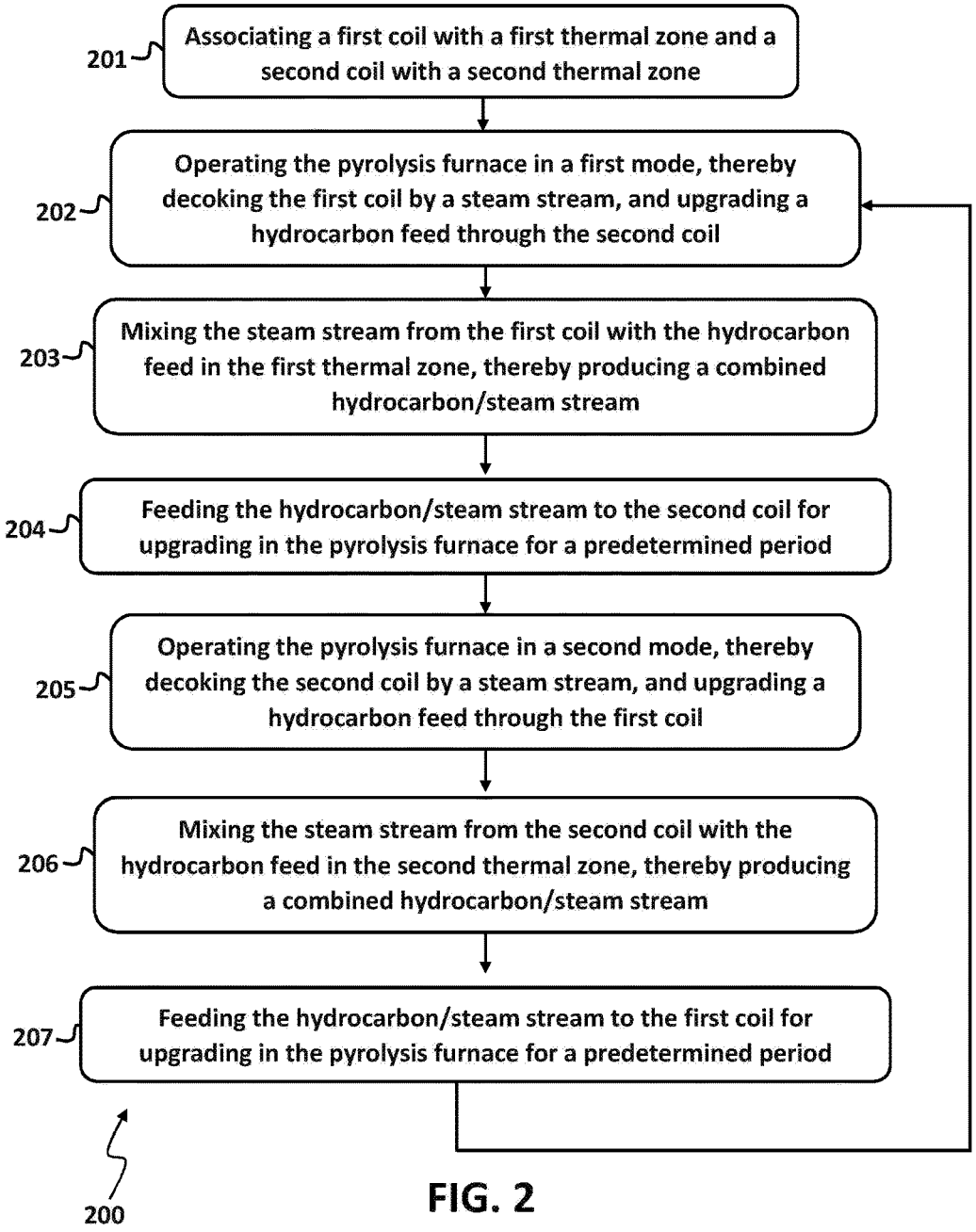
FIG. 2 is a flowchart of a method for upgrading a hydrocarbon feed, according to one or more implementations of the present disclosure.

FIG. 2 illustrates a method 200 for upgrading a hydrocarbon feed according to one or more implementations of the present disclosure. As represented in FIG. 2, in one implementation, the method 200 includes a first step 201 of associating at least a first coil with, a first thermal zone of the pyrolysis furnace and associating at least a second coil with a second thermal zone of the pyrolysis furnace. In some implementations, the second thermal zone is spaced apart or otherwise separated from the first thermal zone. A second step 202 can involve operating the pyrolysis furnace in a first mode. In one implementation, the first mode comprises upgrading a first hydrocarbon feed in the second coil, feeding a first steam stream to the first coil, thereby heating the first steam, stream, and decoking the first coil.

Additional steps in the first mode can include a third step 203 of mixing the first steam, stream from the first coil with the first hydrocarbon feed in the first thermal zone, thereby producing a combined first hydrocarbon/steam stream, and a fourth step 204 of feeding the first hydrocarbon/steam stream to the second coil in the second thermal zone. Furthermore, a fifth step 205 may include operating the pyrolysis furnace in a second mode. In one implementation, the second mode can include upgrading a second hydrocarbon feed in the first coil, feeding a second steam stream to the second coil, thereby heating the second steam, stream, and decoking the second coil. A subsequent sixth step 206 involves mixing the second steam stream from the second coil with the second hydrocarbon feed in the second thermal zone, thereby producing a combined second hydrocarbon/steam stream, and a seventh step 207 of feeding the second hydrocarbon/steam stream to the first coil in the first thermal zone.

In other implementations, the method can comprise other or alternative steps. It should be understood that one of more steps identified in the following method can be substituted for any of the steps described above for method 200 or added to the method 200. For example, in other implementations of the method, a first step comprises providing a pyrolysis furnace having a number of coils, for example a first coil and a second coil; a second step of feeding a steam stream, to the first coil in order to be heated in the pyrolysis furnace; a third step of combining the heated steam from the first coil with the hydrocarbon feed to obtain a combined hydrocarbon/steam stream; a fourth step of feeding the hydrocarbon/steam stream to the second coil for upgrading in the pyrolysis furnace for a predetermined period; a fifth step of diverting the steam stream to the second coil; a sixth step of combining the heated steam from the second coil with the hydrocarbon feed to obtain a combined hydrocarbon/steam stream; and a seventh step of feeding the combined hydrocarbon/steam stream to the first coil in order to be upgraded in the pyrolysis furnace for a predetermined period. In some implementations, the cycle from the second step to the seventh step is repeated, where the hydrocarbon feed may first be upgraded in the second coil, while the first coil may be decoked by the steam and then the streams of the first and the second coils, may be switched, such that hydrocarbon feed may be upgraded in the first coil, while the second coil may be decoked by the steam. This cycle may be continued to form a cyclic process in which upgrading and decoking may continuously and periodically be performed in a number of coils in the pyrolysis furnace.

Furthermore, with reference to FIG. 2, in one implementation, in first step 201 of method 200 the pyrolysis furnace may be associated with, be provided with, or otherwise include a number of thermal zones, for example a first thermal zone and a second thermal zone. The pyrolysis furnace may also include a number of coils, for example a first coil and a second coil, that may pass through or be disposed within the first and the second thermal zones. As noted above, in one implementation, the first and the second thermal zones may be capable of functioning as convection zones or radiant zones and the functionality of the thermal zones may be switched between a convection zone and a radiant zone.

Figure 3A:
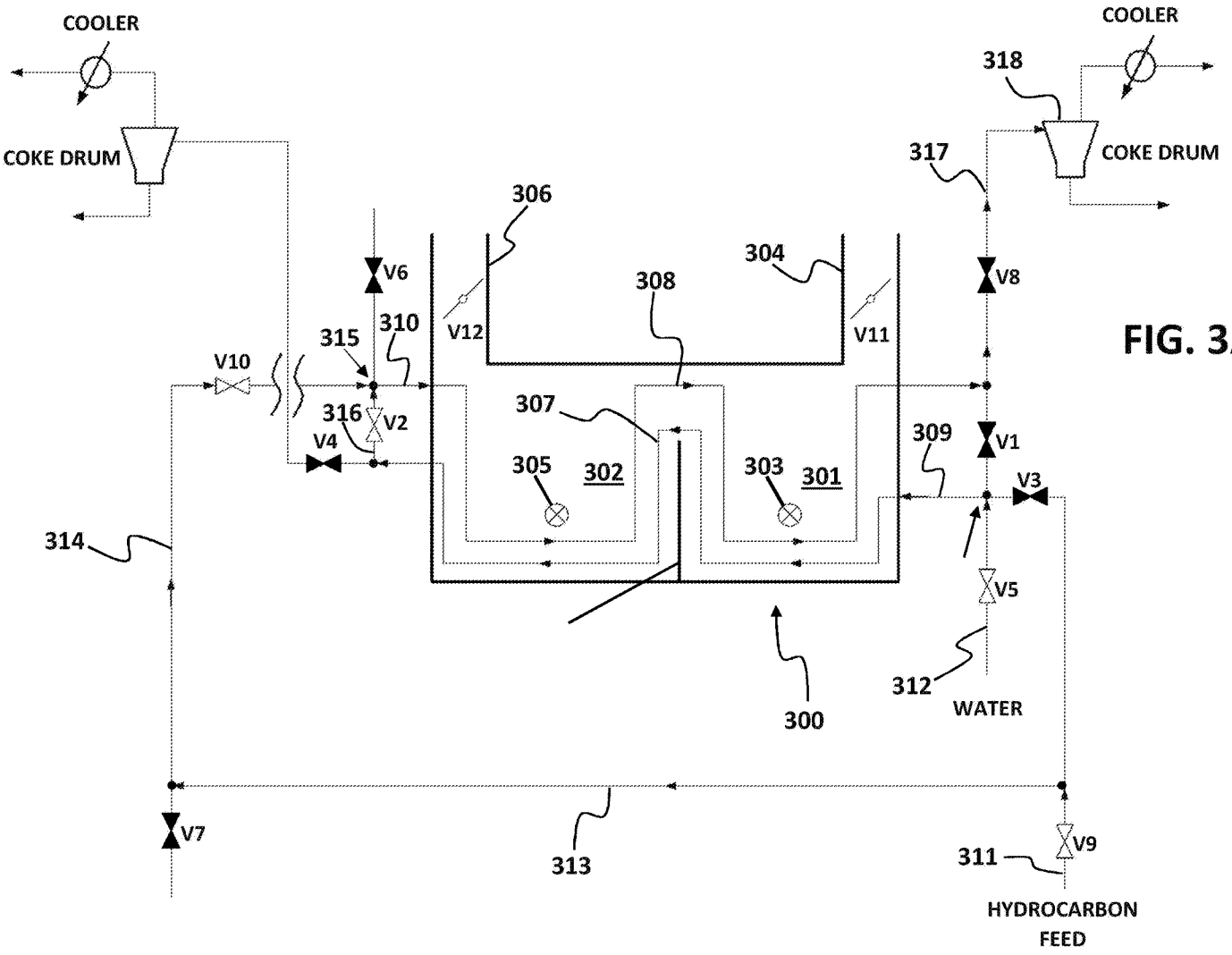
FIG. 3A is a schematic representation of a pyrolysis furnace with two coils in a first run mode according to an implementation of the present disclosure.
Figure 3B:
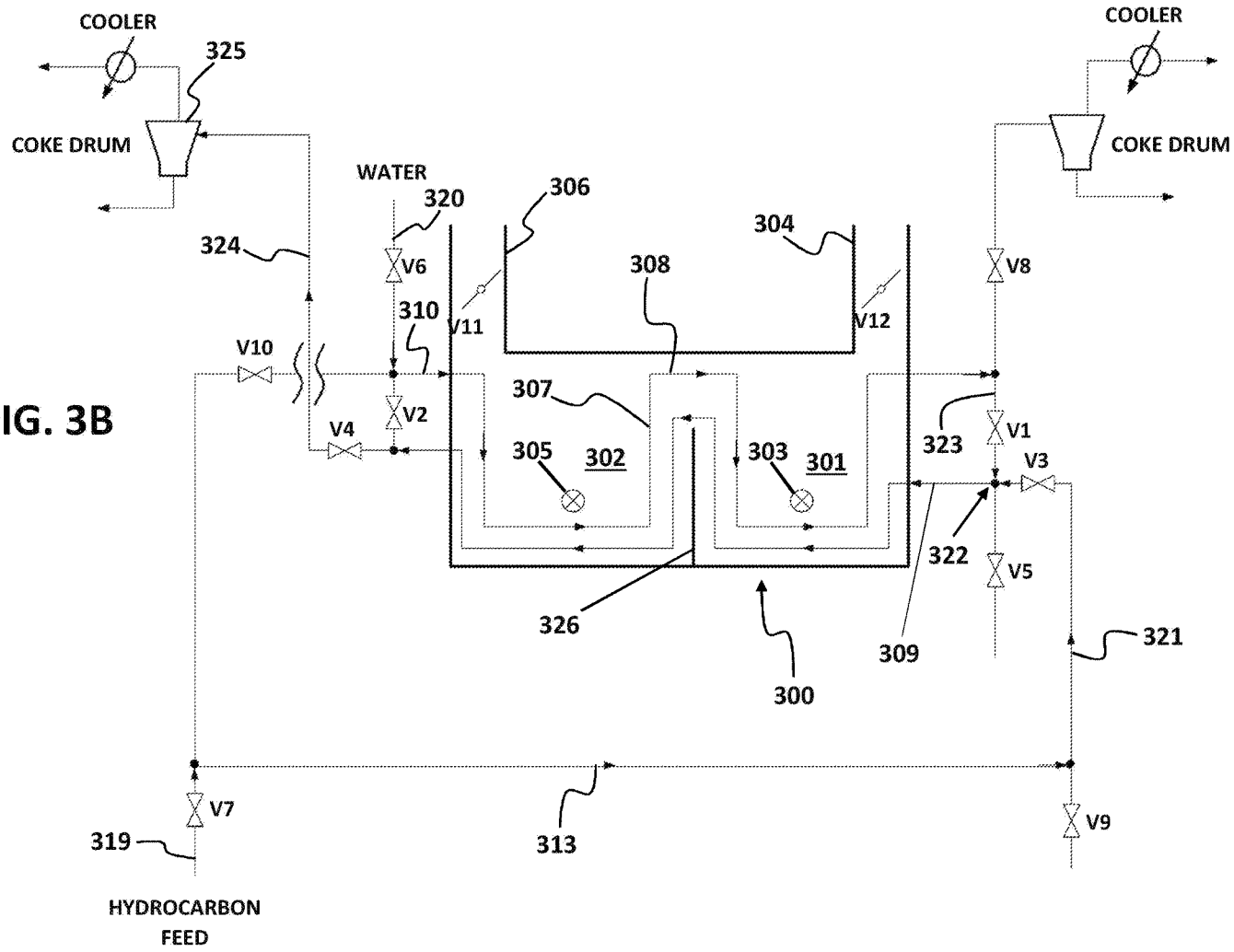
FIG. 3B is a schematic representation of a pyrolysis furnace with two coils in a second run mode according to an implementation of the present disclosure.

Referring now to FIGS. 3A and 3B, two schematics of a pyrolysis furnace 300 configured to operate according to the method of FIG. 2 is illustrated. The pyrolysis furnace 300 may include a first thermal zone 301 and a second thermal zone 302. In some implementations, the first thermal zone 301 includes a first burner 303 and a first stack 304 that may be controlled by valve V11. In addition, in some implementations, the second thermal zone 302 may include a second burner 305 and a second stack 306 that may be controlled by valve V12.

As noted earlier, in order for each thermal zone to function as a convection zone, the respective burner of that thermal zone may be turned off or alternatively operate at a lower capacity, and the respective stack of that zone may be opened. For example, in order for the first thermal zone 301 to function as a convection zone, first burner 303 may be turned off or alternatively the first burner 303 may operate at a lower capacity, and the first stack 304 may be opened by valve V11.

Furthermore, in order for each thermal zone to function as a radiant zone, the respective burner of that zone may be turned on and the respective stack of that zone may be closed. For example, in order for the first thermal zone 301 to function as a radiant zone, first burner 303 may be turned on and the first stack 304 may be closed by valve V11.

With further reference to FIG. 3A, in one implementation, pyrolysis furnace 300 may include a first coil 307 and a second coil 308. In some implementations, the first coil 307 may be supplied from a first line 309 and the second coil 308 may be supplied from a second line 310. References to "lines" herein can refer to any kind of fluid transportation, feed, or supply system or network, including but not limited to lines, pipes, tubes, or other fluid transfer vessels or components. The pyrolysis furnace 300 may operate in two modes: in a first mode, the hydrocarbon feed is upgraded in the second coil 308 while the first coil 307 is decoked by a stream of steam fed through the first coil 307; and, in a second mode, the steam stream is diverted to the second coil 308 in order to decoke the second coil 308 while the hydrocarbon feed is upgraded in the first coil 307. The hydrocarbon feed that is to be upgraded in each coil may be mixed prior entering the pyrolysis furnace 300 with the heated steam or water in the other coil in some implementations.

Referring again to FIG. 3A, in one implementation of the first mode, hydrocarbon feed may be supplied from a third line 311 that may be controlled or otherwise managed by valve V9 and water or steam may be supplied from a fourth line 312 that may be controlled by valve V5. During the first mode, in one implementation, valves V2, V5, V8, V9, and V10 may be opened while valves V1, V3, V4, V6, and V7 may be closed. Hydrocarbon feed supplied from a third line 311 may flow through a fifth line 313 and then through a sixth line 314 to node 315. Water or steam supplied from fourth line 312 may flow through first line 309 that supplies the first coil 307. Water or steam supplied from first line 309 to the first coil 307 may first enter the first thermal zone 301, which in this mode functions as a radiant zone (whereby the first burner 303 may be turned on and the first stack 304 may be closed by valve V11).

Afterwards, the steam may continue to flow in the first coil 307 to the second thermal zone 302, which in this mode function as a convection zone (whereby the second burner 305 may be turned off or operate at a lower capacity and the second stack 306 may be opened by valve V12). The heated steam from the first coil 307 may flow through a seventh line 316 that may be controlled by valve V2 to the node 315, where the heated steam may be mixed with, the hydrocarbon feed. The mixture of the hydrocarbon and steam may then be fed to the second coil 308 via second line 310. The mixture (i.e., hydrocarbon/steam mixture) may initially enter the second thermal zone 302. The second thermal zone 302 functions as a convection zone in this mode and the hydrocarbon/steam mixture may be preheated in the second thermal zone 302 before it enters the first thermal zone 301 (i.e., at this time a radiant zone). The upgrading process may occur in the second coil 308 while it is being heated in the first thermal zone 301 (i.e., at this time a radiant zone).

In other implementations, the pyrolysis furnace 300 may include more than one radiant zone. The upgraded or partially upgraded hydrocarbon from the second coil 308 may flow through an eighth line 317 that may be controlled by valve V8 to a coke drum 318 for further separation in some implementations. In one implementation, the first thermal zone 301 and the second thermal zone 302 are separated by a refractory wall 326.

Referring now to FIG. 3B, it can be seen that in one implementation of the second mode, hydrocarbon feed may be supplied from a ninth line 319 that is controlled by valve V7 and water or steam may be supplied from a tenth line 320 that is controlled by valve V6. In some implementations of the second mode, valves V1, V3, V4, V6, and V7 are opened while valves V2, V5, V8, V9, and V10 are closed. Hydrocarbon feed supplied from ninth line 319 may flow through fifth line 313 and then through an eleventh line 321 to node 322. Water or steam supplied from tenth line 320 may flow through second line 310 that supplies the second coil 308. Water or steam supplied from second line 310 to the second coil 308 may first enter the second thermal zone 302, which in this mode functions as a radiant zone (whereby the second burner 305 is turned on and the second stack 306 is closed by valve V11).

Following this step, the steam may continue to flow in the second coil 308 to the first thermal zone 301, which in this mode functions as a convection zone (whereby the first burner 303 is turned off or operates at a lower capacity and the first stack 304 is opened by valve V12). The heated steam from the second coil 308 may flow through a twelfth line 323 that may be controlled by valve V1 to the node 322, where the heated steam may be mixed with the hydrocarbon feed. The mixture of the hydrocarbon and steam may then be fed to the first coil 307 via first line 309. The mixture (i.e., hydrocarbon/steam mixture) may first enter the first thermal zone 301. The first thermal zone 301 functions as a convection zone in the second mode and the hydrocarbon/steam mixture may be preheated in, the first thermal zone 301 before it enters the second thermal zone 302 (i.e., at this time a radiant zone). The upgrading process may occur in the first coil 307 while it is being heated in the second thermal zone 302 (i.e., at this time a radiant zone).

In other implementations, the pyrolysis furnace 300 may include more than one radiant zone. The upgraded or partially upgraded hydrocarbon from the first coil 307 may flow through a thirteenth line 324 that may be controlled by valve V4 to a coke drum 325 for further separation.

Figure 4:
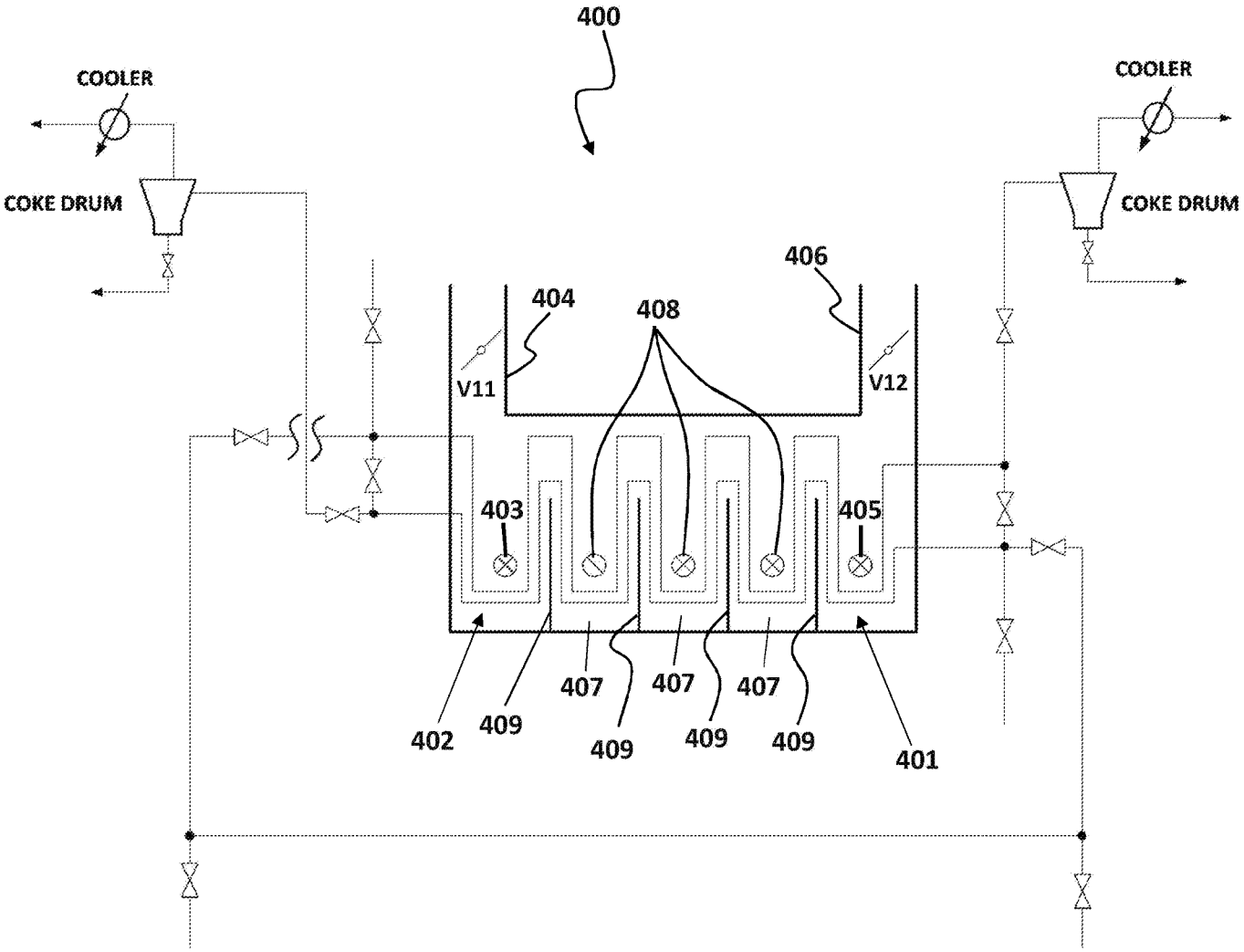
FIG. 4 is a schematic representation of a pyrolysis furnace with multiple thermal zones, according to an implementation of the present disclosure.

Referring now to FIG. 4, a pyrolysis furnace 400 with a plurality of thermal zones is illustrated according to an implementation of the present disclosure. In some implementations, the pyrolysis furnace 400 may include two thermal zones disposed at either end of the pyrolysis furnace 400. For example, a first thermal zone 401 may be disposed along a first end and a second thermal zone 402 may be disposed along a second end. In one implementation, the first thermal zone 401 may include a first burner 403 and a first stack 404 and the second thermal zone 402 may include a second burner 405 and a second stack 406. In some implementations, the first thermal zone 401 and the second thermal zone 402 may be symmetrically arranged.

According to some implementations, the first thermal zone 401 and the second thermal zone 402 may be capable of functioning as both a convection zone and a radiant zone. In order for each thermal zone to function as a convection zone, the respective burner of that zone may be turned off or alternatively operate at a lower capacity and the respective stack of that zone may be opened. For example, in order for the second thermal, zone 402 to function as a convection zone, the second burner 405 is turned off or alternatively the second burner 405 operates at a lower capacity, and the second stack 406 is opened by valve V11. In order for each thermal zone to function as a radiant zone, the respective burner of that zone is turned on and the respective stack of that zone is closed. For example, in order for the second thermal zone 402 to function as a radiant zone, second burner 405 may be turned on and the second stack 406 may be closed by valve V11.

With further reference to FIG. 4, at least one thermal zone may be provided between the first thermal zone 401 and the second thermal zone 402. For example, in, the implementation shown in FIG. 4, there may be three thermal zones 407 disposed between the first thermal zone 401 and the second thermal zone 402. In other implementations, thermal zones 407 can comprise one thermal zone, two thermal zones, or more than three thermal zones. In some implementations, pyrolysis furnace 400 may include, for example 3 to 10 thermal zones. Thermal zones 407 may include burners 408 and may function as radiant zones. In some implementations, thermal zones can be separated by refractory walls 409.

In different implementations, the system can include other features to facilitate the operation of the thermal zones. For example, in some exemplary implementations, the heated steam is combined with the hydrocarbon feed, with a steam to hydrocarbon ratio of between 0.1 and 3, In addition, in some implementations, the temperature of steam and/or the hydrocarbon feed at the outlets of the first coil and the second coil can be between 300 and 900 degrees Celsius. In one exemplary implementation, the absolute pressure of steam and the hydrocarbon feed at the outlet of the first and the second coils is between 0.1 bar-abs and 300 bar-abs.

According to some implementations, the method and the pyrolysis furnace as disclosed herein may be utilized in catalytic versions of hydrocarbon upgrading processes, in which catalysts may be provided inside the coils in the form of, for example, catalyst pellets, internal coating of the coil with the catalyst, etc. In this implementation, the steam may be mixed with a catalyst regeneration agent.

While the foregoing has described what are considered to be the best mode and/or other examples, it is understood that various modifications may be made therein and that the subject matter disclosed, herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for upgrading a hydrocarbon feed in a pyrolysis furnace, the method comprising:

dividing the pyrolysis furnace into a first thermal zone and a second thermal zone;

operating the pyrolysis furnace in a first mode, the first mode comprising:

feeding a first steam stream to a first coil, the first steam stream flowing through the first coil in a first direction from the first thermal zone to the second thermal zone;

forming a first hydrocarbon/steam stream by mixing a first hydrocarbon feed with the first steam stream from the first coil; and feeding the first hydrocarbon/steam stream to a second coil, the first hydrocarbon/steam stream flowing through the second coil in a second direction from the second thermal zone to the first thermal zone, the second direction opposite the first direction.

2. The method according to claim 1, further comprising:

operating the pyrolysis furnace in a second mode, the second mode comprising:

feeding a second steam stream to the second coil, the second steam stream flowing through the second coil in the second direction;

forming a second hydrocarbon/steam stream by mixing a second hydrocarbon feed with the second steam stream from the second coil; and feeding the second hydrocarbon/steam stream to the first coil, the second hydrocarbon/steam stream flowing through the first coil in the first direction.

3. The method according to claim 2, wherein dividing the pyrolysis furnace into the first thermal zone and the second thermal zone comprises dividing the pyrolysis furnace into the first thermal zone and the second thermal zone, the first thermal zone comprising a first burner and a first stack, the second thermal zone comprising a second burner and a second stack.

4. The method according to claim 3, wherein the first mode further comprises:

turning off or decreasing the second burner; and opening the second stack.

5. The method according to claim 4, wherein the second mode further comprises:

turning off or decreasing the first burner; and opening the first stack.

6. The method of claim 2, further comprising operating the pyrolysis furnace in the first mode and then the second mode in a series of repeating cycles.

7. The method according to claim 1, wherein dividing the pyrolysis furnace into the first thermal zone and the second thermal zone further comprises separating the first thermal zone and the second thermal zone by at least one refractory wall.

8. The method according to claim 1, further comprising mixing the first steam stream with an oxidizing agent, wherein the oxidizing agent is one of oxygen, air, $H_2O_2$, an alcohol, and combinations thereof.

9. The method according to claim 1, wherein feeding the first steam stream to the first coil and feeding the first hydrocarbon/steam stream to the second coil are carried out simultaneously.

10. The method according to claim 1, further comprising:

operating the pyrolysis furnace in a second mode, the second mode comprising:

feeding a second steam stream to the second coil, the second steam stream flowing through the second coil in the second direction;

forming a second hydrocarbon/steam stream by mixing a second hydrocarbon feed with the second steam stream from the second coil; and feeding the second hydrocarbon/steam stream to the first coil, the second hydrocarbon/steam stream flowing through the first coil in the first direction, wherein feeding the second steam stream to the second coil and feeding the second hydrocarbon/steam stream to the first coil are carried out simultaneously.

11. A method for upgrading a hydrocarbon feed in a pyrolysis furnace, the method comprising:

dividing the pyrolysis furnace into a first thermal zone and a second thermal zone by separating the first thermal zone and the second thermal zone by at least one refractory wall;

operating the pyrolysis furnace in a first mode, the first mode comprising:

decoking a first coil of the pyrolysis furnace by feeding a first steam stream to a first coil, the first steam stream flowing through the first coil in a first direction from the first thermal zone to the second thermal zone;

forming a first hydrocarbon/steam stream by mixing a first hydrocarbon feed with the first steam stream from the first coil; and upgrading the first hydrocarbon feed by feeding the first hydrocarbon/steam stream to a second coil, the first hydrocarbon/steam stream flowing through the second coil in a second direction from the second thermal zone to the first thermal zone, the second direction opposite the first direction;

operating the pyrolysis furnace in a second mode, the second mode comprising:

decoking the second coil of the pyrolysis furnace by feeding a second steam stream to the second coil, the second steam stream flowing through the second coil in the second direction;

forming a second hydrocarbon/steam stream by mixing a second hydrocarbon feed with the second steam stream from the second coil; and upgrading the second hydrocarbon feed by feeding the second hydrocarbon/steam stream to the first coil, the second hydrocarbon/steam stream flowing through the first coil in the first direction, alternating between the first mode and the second mode in a series of repeating cycles, wherein, upgrading the first hydrocarbon feed in the second coil is carried out simultaneously with decoking the first coil, and wherein, upgrading the second hydrocarbon feed in the first coil is carried out simultaneously with decoking the second coil.

* * * * *